United States Patent [19]

Nedonchelle

[11] Patent Number: 5,017,296

[45] Date of Patent: May 21, 1991

[54] LIQUID DETERGENT COMPOSITION CONTAINING A SMELTITE CLAY SOFTENING AGENT

[75] Inventor: Yvon J. Nedonchelle, Lille, France

[73] Assignee: Lever Brothers Company, Division of Conopco, Inc., New York, N.Y.

[21] Appl. No.: 338,499

[22] Filed: Apr. 13, 1989

Related U.S. Application Data

[63] Continuation of Ser. No. 930,583, Nov. 13, 1986, abandoned.

[30] Foreign Application Priority Data

Nov. 22, 1985 [GB] United Kingdom ..... 8528798

[51] Int. Cl.[5] ..... C11D 3/12; C11D 3/14; D06M 11/79

[52] U.S. Cl. ..... 252/8.6; 252/140; 252/174.25

[58] Field of Search ..... 252/8.6, 140, 174.25

[56] References Cited

U.S. PATENT DOCUMENTS

| | | | |
|---|---|---|---|
| 3,962,100 | 6/1976 | Murphy et al. | 252/8.8 |
| 4,062,647 | 12/1977 | Storm et al. | 8/137 |
| 4,419,250 | 12/1983 | Allen et al. | 252/8.6 |
| 4,436,637 | 3/1984 | Ramachandran et al. | 252/8.6 |
| 4,452,717 | 6/1984 | Tai et al. | 252/135 |
| 4,469,605 | 9/1984 | Ramachandran et al. | 252/174.25 |
| 4,626,364 | 12/1986 | Bauman | 252/8.8 |
| 4,715,969 | 12/1987 | Rothanavibhata et al. | 252/8.6 |
| 4,885,101 | 12/1989 | Tai | 252/140 |

FOREIGN PATENT DOCUMENTS

| | | | |
|---|---|---|---|
| 202395 | 12/1982 | Japan | 252/174.25 |
| 2132629 | 7/1984 | United Kingdom . | |
| 2159533 | 12/1985 | United Kingdom . | |
| 2168717 | 6/1986 | United Kingdom . | |

OTHER PUBLICATIONS

Henry E. and Taylor, N., *Journal of the American Ceramic Society,* vol. 21, 1938, pp. 165–175.

Grimshaw, R., *The Chemistry and Physics of Clays,* Wiley-Interscience, N.Y., 1971, pp. 483–490.

Kirk-Othmer, "Encyclopedia of Chemical Technology", Third Edition, vol. 6, pp. 197–198.

Abstract 83JP-247999.

*Primary Examiner*—Paul Lieberman

*Assistant Examiner*—Linda D. Skaling

*Attorney, Agent, or Firm*—Rimma Mitelman

[57] ABSTRACT

Liquid detergent compositions are disclosed for softening and washing fabrics comprising an aqueous base, a detergent active material such as a mixture of anionic and nonionic materials, a detergency builder, such as sodium tripolyphosphate, and a special fabric softening clay which swells in water but not in sodium tripolyphosphate solution. The use of such clays enable the product to be prepared without an undesirably high viscosity.

6 Claims, No Drawings

LIQUID DETERGENT COMPOSITION CONTAINING A SMELTITE CLAY SOFTENING AGENT

This is a continuation application of Ser. No. 930,583, filed Nov. 13, 1986 now abandoned.

This invention relates to a liquid detergent composition, in particular to a liquid detergent composition for washing fabrics and imparting a softness thereto.

British Patent Specification No GB 2 132 629-A describes a fabric softening heavy duty liquid detergent which contains finely divided swelling bentonite as a fabric softening material. A number of suitable bentonite materials is suggested for use, including Wyoming bentonite.

We have found that these recommended bentonites when incorporated in liquid detergent compositions, especially those such compositions which exist as structured liquids, significantly increase the viscosity of the product. Viscosity is an important property. Too low a viscosity can result in long term product instability when the product contains undissolved material in suspension, whereas too high a viscosity makes product processing and use by the consumer difficult.

We have surprisingly found a class of fabric softening clay materials which do not significantly increase product viscosity in such products but yet still provide a softness benefit on fabrics treated with the product.

Two dispersions are prepared at room temperature containing respectively:

A—475g water and 25g of clay material;

B—435g of water, 40g sodium tripolyphosphate and 25g of clay material (the sodium tripolyphosphate is completely dissolved in the water before the addition of the clay).

The dispersions are stirred for 5 minutes with a magnetic stirrer and then placed in a 1000 ml measuring cylinder. The dispersions are then left to stand, undisturbed for two weeks. After this time the dispersions are examined. Generally some separation will have occurred. A lower layer of dispersion or gel containing the clay will be visibly distinguishable from a relatively clear upper layer. The height of the lower layer (h) and the overall height of the total liquid (H) are determined and percentage swellability (S) is calculated using the expression $$S = \frac{h}{H} \times 100$$

We have found that clay materials having a swellability (S) of more than 36%, preferably more than about 75% in dispersion A, and less than 25%, preferably less than about 20% in dispersion B are useful in the present composition.

The following Table identifies a number of useful clay materials in this respect.

TABLE

| TRADE NAME | CLAY TYPE | S(%) DISPERSION A | S(%) DISPERSION B |
|---|---|---|---|
| CLARSOL STF | Kaolinite | 9 | 14 |
| MKIC | Kaolinite | 9 | 15 |
| CLARSOL ATC | Attapulgite | 95 | 63 |
| BENTONE EW | Hectorite | 100 | 65 |
| CLARSOL W100 | Na Bentonite | 100 | 98 |
| CLARSOL KC1 | Ca Bentonite | 36 | 86 |
| MDO 77/84 | Ca Bentonite | 9 | 73 |
| LAUNDROSIL DG | Ca Bentonite | 1 | 75 |
| CP 103 | Ca Bentonite | 10 | 95 |
| MARMORA | Ca Bentonite | 15 | 10 |
| CLARSOL KC1 | Ca Bentonite accurately[1] activated with sodium carbonate | 100 | 98 |
| MDO 77/84 | Ca Bentonite accurately[1] activated with sodium carbonate | 98 | 48 |
| LAUNDROSIL DG AC | Ca Bentonite accurately[1] activated with sodium carbonate | 100 | 51 |
| CP103 | Ca Bentonite accurately[1] activated with sodium carbonate | 100 | 100 |
| MARMORA | Ca Bentonite accurately[1] activated with sodium carbonate | 100 | 15 |
| CLARSOL KC2 | Ca Bentonite commercially[1] activated with sodium carbonate | 100 | 68 |
| MDO 81/84 | Ca Bentonite commercially[1] activated with sodium carbonate | 100 | 36 |
| LAUNDROSIL DG AC | Ca Bentonite commercially[1] activated with sodium carbonate | 100 | 25 |
| DOKUM KARAKAYA | Ca Bentonite commercially[1] activated with sodium carbonate | 95 | 16 |
| BENTONITE DC | acid activated calcium bentonite | 10 | 10 |
| STEETLEY NO 1 | white bentonite | 68 | 14 |
| STEETLEY NO 2 | white bentonite | 75 | 20 |

Thus, according to the present invention, there is provided a liquid detergent composition for washing fabrics and imparting softness thereto, the composition comprising (i) an aqueous base;

(ii) a detergent active material or a mixture thereof;

(iii) at least 5% by weight of a detergent builder; and (iv) a fabric softening clay material having a swellability in water (determined as herein described) of more than 36% and a swellability in an 8% sodium tripolyphosphate solution of less than 25%.

The fabric softening clay materials which are useful in the compositions are characterised by their swelling behaviour, which is quantified by the following test.

1 —commercial activation with sodium carbonate usually results in the presence of excess sodium carbonate in the treated material. Accurate activation is carried out with the objective of leaving no excess sodium carbonate.

Of the clay materials listed in this Table, only DOKUM KARAKAYA, accurately activated MARMORA and STEETLEY NOS. 1 and 2 meet the requirements of the present invention.

We have found it indeed surprising that some clay materials which have a low swellability in sodium tripolyphosphate solutions will swell considerably in water and will, when incorporated in products as described herein, provide fabrics washed therewith with a softening benefit.

It would appear that the clay materials which are useful in the present invention are some lamella smectite clays containing exchangeable sodium and calcium cations. Clay materials which are free of these ions, such as acid activated clays, do not swell sufficiently in water and do not provide a fabric softening benefit. It will be appreciated that in a practical liquid detergent product, the exchangeable cationics of the clay will exchange with those of the electrolyte system of the product prior to its actual use in the wash process. The softening benefit will therefore relate to this exchanged form.

The level of fabric softening clay material in the product is preferably at least 1% by weight, but not more than 10% by weight. A most preferred level is from 3% to 7% by weight.

The detergent compositions of the present invention necessarily contain one or more detergent active materials.

The detergent compounds may be selected from anionic, nonionic, zwitterionic and amphoteric synthetic detergent active materials. Many suitable detergent compounds are commercially available and are fully described in the literature, for example in "Surface Active Agents and Detergents", Volumes I and II, by Schwartz, Perry and Berch.

The preferred detergent compounds which can be used are synthetic anionic and nonionic compounds. The former are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced for example from tallow or coconut oil, sodium and potassium alkyl ($C_9$–$C_{20}$) benzene sulphonates, particularly sodium linear secondary alkyl $C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolysing with a base to produce a random sulphonate; and olefin sulphonates, which term is used to describe the material made by reacting olefins, particularly $C_{10}$–$C_{20}$ alpha-olefins, with $SO_3$ and then neutralising and hydrolysing the reaction product. The preferred anionic detergent compounds are sodium ($C_{11}$–$C_{15}$) alkyl benzene sulphonates and sodium $C_6$–$C_{18}$) alkyl sulphates.

Suitable nonionic detergent compounds which may be used include in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, generally 5 to 25 EO, ie 5 to 25 units of ethylene oxide per molecule, the condensation products cf aliphatic ($C_8$–$C_{18}$) primary or secondary linear or branched alcohols with ethylene oxide, generally 5 to 40 EO, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

Amounts of amphoteric or zwitterionic detergent compounds can also be used in the compositions of the invention but this is not normally desired due to their relatively high cost. If any amphoteric or zwitterionic detergent compounds are used it is generally in small amounts in compositions based on the much more commonly used synthetic anionic and/or nonionic detergent compounds.

Mixtures of detergent active materials may be used. In particular, we prefer a mixture of an anionic detergent active, a nonionic detergent active and soap, particularly when the product is in the form of a structured liquid.

Where the detergent active material is soap, this is preferably selected from alkali metal salts of fatty acids having 12 to 18 carbon atoms. Typical such fatty acids are oleic acid, ricinoleic acid, and fatty acids derived from castor oil, rapeseed oil, groundnut oil, coconut oil, palmkernel oil or mixtures thereof. The sodium or potassium salts of these acids can be used.

The level of detergent active material in the product is preferably at least 2% by weight, but not more than 45% by weight, most preferably from 6% to 15% by weight.

The products according to the invention necessarily contain a detergency builder material to reduce the level of free calcium ions in the wash liquor and thereby improve detergency. This material may be selected from precipitating detergency builder materials such as alkali metal carbonates and ortho-phosphates, ion-exchange builder materials such as alkali metal aluminosilicates and sequestering builder materials such as alkali metal tripolyphosphates, citrates and nitrilotriacetates. Particularly preferred is sodium tripolyphosphate for reasons of product structure and building efficiency. At least 5% by weight of the detergency builder material is required to provide a noticeable effect upon detergency.

It is particularly preferred that the product be in the form of a structured liquid, that is a liquid which contains a detergent in the lamella phase, which provides the product with rheological properties such that any undissolved material is held in stable homogeneous suspension. This enables the product to contain relatively high levels of detergency builder. The lamella phase is obtained by a critical choice of detergent active materials. European patent specification No EP-A-38101 (UNILEVER) describes such a product which contains sodium tripolyphosphate and a detergent active mixture containing an anionic detergent active material, a nonionic detergent active material and a soap, the level of the sodium tripolyphosphate being more than would be soluble in the product, with the result that some of the tripolyphosphate remains undissolved but stably suspended in the product.

It is a preferred feature of the present invention that the level of detergency builder material in the product is more than would dissolve at 20° C. In the case of sodium tripolyphosphate, a preferred level is from 22 to 35% by weight, based on the weight of the product.

The liquid detergent composition of the invention may further contain any of the adjuncts normally used in fabric washing detergent compositions, eg sequestering agents such as ethylenediamine tetraacetate; buffering agents such as alkali silicates; soil suspending and anti-redepositon agents such as sodium carboxymethyl cellulose and polyvinylpyrrolidone; fluorescent agents; perfumes; germicides; and colourants.

Further, the addition of lather depressors such as silicones, and enzymes, particularly proteolytic and amylolytic enzymes; and peroxygen bleaches, such as sodium perborate and potassium dichlorocyanurate, including bleach activators, such as N,N,N',N',- tetraacetyl ethylene diamine, may be useful to formulate a complete heavy duty detergent composition suitable for use in washing machines.

Also particularly beneficial are agents for improving the thermal stability of the product, such as sodium toluene sulphonate, xylene sulphonate or cumene sulphonate, at levels of up to 1% by weight, such as from 0.4% to 0.5%.

The products of the present invention may be prepared by a variety of methods. However, we have found that benefits arise from mixing ingredients in a particular order. Thus, it is preferable to add a portion of the detergency builder to water, before adding the clay and the detergent active material. In this way products having uniform rheological properties from batch to batch can be obtained. In particular, a preferred method is to add the necessary quantity of water at an elevated temperature of say 40° C.-80° C. to a mixing vessel provided with a stirrer. An amount of between one part in twenty and one part in four of the detergency builder is then added, with stirring. Where the detergency builder is water-soluble, this amount will dissolve in the water and prevent the clay material from swelling but will not be sufficient to impair the stability of the surfactant. The clay material is then added and dispersed with stirring. Anionic and nonionic detergents, including soap where this is present, are then added. The remaining part of the detergency builder is then added while maintaining this elevated temperature with stirring until a homogeneous mass is obtained.

Finally, the mixture is cooled under constant agitation and water is added, if necessary, to compensate evaporation loss. Thereafter perfume may be added when the product is at substantially ambient temperature.

When, alternatively, the clay is added to the water before any detergency builder, the clay swells producing a composition which may have a viscosity which is higher than desired. If all the detergency builder is added before the clay a product may result which separates on standing. If both the detergent active material and the detergency builder are added before the clay, the product may already have a high viscosity so that the powdered clay cannot easily be added without at the same time introducing air into the product resulting in a product having a density lower than may be desired.

The compositions of the invention should have a viscosity of less than 3000, preferably less than 1500 cPs measured at 20° C and at a shear rate of 21 sec Most preferably the viscosity is between 650 and 850 cPs. Viscosities below 650 cPs can result in a loss of product stability.

The invention will now be illustrated by the following examples.

EXAMPLE 1

A liquid detergent composition was prepared according to the following formulation:

| Ingredient | % (by weight) |
|---|---|
| Sodium $C_{12}$-alkyl benzene sulphonate | 6.5 |
| Soap | 1.0 |
| Alcohol ethoxylate 7EO | 2.5 |
| Clay | 5.0 |
| Sodium carboxymethyl cellulose (SCMC) | 0.1 |
| Sodium tripolyphosphate (STP) | 22.8 |
| Sodium silicate | 1.0 |
| Fluorescent agent | 0.1 |
| Glycerol | 4.85 |
| Borax | 3.1 |
| Silicone | 0.16 |
| Perfume | 0.29 |
| Proteolitic enzyme | 0.80 |
| Water | balance |

This composition was made by the following method:

The water is heated to 60° C. and maintained at that temperature. 2% STP is added, followed by the clay, SCMC, fluorescer, sodium hydroxide, silicate, glycerol, borax, fatty acid and sulphonic acid (which with the sodium hydroxide generate the soap and the anionic detergent active respectively) and nonionic active while stirring is continued. After 10 minutes agitation the remaining 20.8% STP was added and the mixture was then cooled with further stirring. When eool, the silicone, perfume and enzymes were added.

A number of such compositions were prepared containing different clay materials. In each case the product viscosity was measured at 20° C. and 21 sec$^{-1}$. Each composition was used to wash cotton test cloths using the following wash method:

Cotton terry towelling test cloths which have been preharshened by 10 washes in a commercially available fabric washing powder product SKIP (ex Lever, France), are washed in the test product for 20 minutes at 40° C. using tap water with a hardness of 48° FH. A laboratory scale apparatus having a capacity of 1 liter is used, and three test cloths of size 15cm x 15cm are washed together. After washing, the cloths are rinsed twice in tap water, wrung out and line dried for 24 hours.

After drying, the cotton test cloths were assessed for softness by a panel of 12 experts, each clay being compared against White bentonite, ex Steetley. The results were as follows:

| Clay material (Before incorporation) | supplier | softening | viscosity (cPs) |
|---|---|---|---|
| BENTONITE DC | SUD-CHEMIE | | 870 |
| CLARSOL ATC | CECA | | 1700 |
| MKIC | KAOLINS DU MORBIHAN | significantly | 850 |

-continued

| Clay material (Before incorporation) | supplier | softening | viscosity (cPs) |
|---|---|---|---|
| LAUNDROSIL DG AC | SUD-CHEMIE | poor | 1250 |
| CLARSOL STF | CECA | | 750 |
| BENTONE EW | NATIONAL LEAD | | 1800 |
| MDO 81/84 | ECC | | 1300 |
| LAUNDROSIL DG | SUD-CHEMIE | | 1600 |
| CLARSOL KC 1 | CECA | | 1500 |
| CLARSOL KC 2 | CECA | | 1200 |
| CLARSOL W 100 | CECA | no | 1500 |
| CP 103 | LAPORTE | significant | 1800 |
| MDO 77/84 | ECC | difference | 1350 |
| WHITE BENTONITE | STEETLEY (control) | | 850 |
| CALCIUM BENTONITE | MARMORA | | 750 |

It will be seen from these results that a number of clay materials provide a softening benefit which is not significantly different to WHITE BENTONITE. However, in most cases the viscosity of the products is higher than desirable. Two clay materials, MKIC and CLARSOL STF provide product vicosities equal or less than WHITE BENTONITE. However, in both cases the softening benefit is less preferred.

The only clay material which is comparable to WHITE BENTONITE both in terms of softening and viscosity is the bentonite from MARMORA.

EXAMPLE 2

A mixture of fabric test cloths were washed with detergent compositions as set out below at 40° C. in water having a hardness of 30° FH ($3\times10^{-3}$ molar free calcium ions). Some test cloths consisted of new terry towelling, some consisted of new acrylic fibres and a third group consisted of terry towelling pieces which had been pre-harshened by washing 30 times in a commercially available softener-free powder product SKIP (ex Lever, France) in 45° FH water. After the mixed test cloths were washed 10 times, rinsed and dried in a conventional manner (without the use of a post-wash fabric softening agent) they were divided into fabric types and assessed for softness by a panel of expert assessors (lower softness scores indicate better softness).

The formulations tested and the results obtained were as follows:

| | EXAMPLE NO: | | | |
|---|---|---|---|---|
| Ingredient (%) | 2WB | 2W | 2P | 2L |
| Anionic detergent active | 6.5 | 6.5 | 5.5 | 14.1 |
| Nonionic detergent active | 2.5 | 2.5 | 2.0 | 12.8 |
| Soap | 1.0 | 1.0 | — | 15.8 |
| Dialkylmethylamine | — | — | 3.8 | — |
| Coconut trimethylammonium chloride | — | — | 1.2 | — |
| Sodium tripolyphosphate | 22.8 | 22.8 | | — |
| Sodium perborate | — | — | 11.7 | — |
| Sodium silicate | 1.0 | 1.0 | 5.7 | — |
| Sodium sulphate | — | — | 22.6 | — |
| Sodium carbonate | — | — | 1.4 | — |
| Sodium carboxymethyl cellulose | 0.1 | 0.1 | 0.8 | — |
| Clay | 5.0 | — | 3.4 | — |
| Water and miscellaneous | | balance | | |
| Product form | Liquid | Liquid | Powder | Liquid |
| Product dosage (per 20 l)g | 215 | 215 | 234 | 155 |

-continued

| | EXAMPLE NO: | | | |
|---|---|---|---|---|
| Ingredient (%) | 2WB | 2W | 2P | 2L |
| SOFTENING SCORES | | | | |
| New terry towelling | 6 | 19 | 18 | 14 |
| Preharshened terry towelling | 5 | 19 | 14 | 13 |
| New acrylic | 7 | 22 | 9 | 14 |

Formulation 2WB is substantially identical to Example 1, utilises STEETLEY NO 1 White Bentonite as the clay component. Formulation 2W is identical except that the clay component has been omitted. Formulations 2P and 2L are intended to represent commercially available fabric washing products used as recommended dosages for those products.

As will be seen from the softening results, formulation 2WB is preferred to all other formulations tested.

I claim:

1. A liquid detergent composition for washing fabrics and imparting softness thereto which comprises:

(i) an aqueous base, (ii) from 2% to 45% by weight detergent active material or a mixture thereof, (iii) 5 to 35% weight of a detergency builder and (iv) from 3 to 7% by weight of a lamella smectite fabric softening clay material containing exchangeable sodium and calcium cations and having a swellability in water of more than 36% and a swellability in an 8% sodium tripolyphosphate solution of less than 25% the viscos of said composition being 650 and 850 of cps measured at 20° C. and at a show rate of 21 $sec^{-1}$.

2. A liquid detergent according to claim 1, comprising from 6% to 15% by weight detergent active material.

3. A liquid detergent according to claim 1, wherein the detergent active material is selected from anionic, nonionic, zwitterionic and amphoteric detergent active materials and mixtures thereof.

4. A liquid detergent according to claim 1, comprising from 22 to 35% by weight detergency builder.

5. A liquid detergent according to claim 1, wherein the detergency builder is selected from precipitating detergency builder materials, ion-exchange builder materials and sequestering builder materials.

6. A liquid detergent according to claim 5, wherein the detergency builder comprises sodium tripolyphosphate.

* * * * *